US007518554B2

(12) United States Patent
Bateman et al.

(10) Patent No.: US 7,518,554 B2
(45) Date of Patent: Apr. 14, 2009

(54) ANTENNA ARRAYS AND METHODS OF MAKING THE SAME

(75) Inventors: Blaine Rexel Bateman, Superior, CO (US); Randy Bancroft, Denver, CO (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 453 days.

(21) Appl. No.: 11/382,190

(22) Filed: May 8, 2006

(65) Prior Publication Data

US 2007/0052593 A1 Mar. 8, 2007

Related U.S. Application Data

(63) Continuation-in-part of application No. 10/817,353, filed on Apr. 2, 2004.

(60) Provisional application No. 60/461,689, filed on Apr. 8, 2003.

(51) Int. Cl.
*H01Q 1/38* (2006.01)

(52) U.S. Cl. ..... 343/700 MS

(58) Field of Classification Search ..... 343/700 MS, 343/731, 846, 790
See application file for complete search history.

(56) References Cited

U.S. PATENT DOCUMENTS 3,757,342 A * 9/1973 Jasik et al. ..... 343/738
4,021,810 A * 5/1977 Urpo et al. ..... 343/731
4,072,951 A * 2/1978 Kaloi ..... 343/700 MS

FOREIGN PATENT DOCUMENTS

| | | |
|---|---|---|
| EP | 0 487 053 A1 | 11/1991 |
| EP | 0 855 760 A2 | 1/1998 |
| JP | 51132058 | 11/1976 |

OTHER PUBLICATIONS

Bahl and Bhartia "Microstrip Antennas" pp. 207-210 and 219.
Philips Research Laboratories, Redhill, Surrey, London, "A Twin Line Omni-Directional Aerial Configuration" 1981, pp. 190-194 XP-000962075.
European Patent Office, "Supplementary European Search Report" Mar. 2, 2006.

* cited by examiner

*Primary Examiner*—Michael C Wimer
(74) *Attorney, Agent, or Firm*—Harness, Dickey & Pierce, P.L.C.

(57) ABSTRACT

An omni direction antenna comprising a substrate having a first side and a second side with a first conductor coupled to the first side of the substrate and a second conductor coupled to the second side of the substrate is provided. The first and second conductors comprise wide elements substantially aligned over narrow elements. The antenna further has a terminating element shorting the first and second conductors. A feed element is coupled to the first side wide element, the feed element comprising at least one transmission line, at least one impedance matching element, and at least one ground plane substantially aligned with the at least one transmission line.

17 Claims, 6 Drawing Sheets

ANTENNA ARRAYS AND METHODS OF MAKING THE SAME

This application is a continuation-in-part of co-pending U.S. patent application Ser. No. 10/817,353, filed Apr. 2, 2004, titled ANTENNA ARRAYS AND METHODS OF MAKING THE SAME, incorporated herein by reference as if set out in full, which claims the benefit of U.S. Provisional Application Ser. No. 60/461,689, filed Apr. 8, 2003, titled ANTENNA ARRAYS AND METHODS OF MAKING THE SAME.

FIELD OF THE INVENTION

The present invention relates to antenna arrays and, more particularly, to omni-directional antenna arrays.

BACKGROUND OF THE INVENTION

Radio frequency antennas are often designed as arrays to provide sufficient gain. Types of omni-directional antennas include series fed arrays, co-linear coaxial (COCO) antenna, and the like. The power feed network associated with antenna arrays, however, is often complex. For example, linear arrays typically use a distributed feed network/power divider for the power feed. This type of power feed network is complex because antenna pattern and gain depend on physical and network parameters making it very difficult to achieve correct phase and amplitude to get maximum gain on azimuth and minimize side lobes. Some physical parameters include the number of elements and their spacing. Some feed network parameters include the phase and amplitude of the power signal at each of the antenna feeds as well as the impedance of the feed network delivering the power. Moreover, array antennas of this type are frequently not readily scalable, are difficult to manufacture, are fragile, and are limited in performance by the accumulation of manufacturing errors in the individual components.

Thus, it would be desirous to provide an omni-directional antenna that had lower errors, was less fragile, and had increased scalability, but retained all the advantages of the simple COCO antenna and removed some of its disadvantages, such as, for example, the requirement to reverse the inner and outer conductor of a coaxial transmission line and it's fixed driving point impedance, which generally requires a matching network.

SUMMARY OF THE INVENTION

To attain the advantages of and in accordance with the purpose of the present invention, an omni-directional planar array antenna is provided. The antenna comprises substrate having a first side and a second side with a first conductor coupled to the first side of the substrate and a second conductor coupled to the second side of the substrate. The first and second conductors comprise wide elements substantially aligned over narrow elements. The antenna further has a terminating element shorting the first and second conductors. A feed element is coupled to the first side wide element, the feed element comprising at least one transmission line, at least one impedance matching element, and at least one ground plane substantially aligned with the at least one transmission line.

The foregoing and other features, utilities and advantages of the invention will be apparent from the following more particular description of a preferred embodiment of the invention as illustrated in the accompanying drawings.

BRIEF DESCRIPTION OF THE DRAWING

The above and other objects and advantages of the present invention will be apparent upon consideration of the following detailed description, taken in conjunction with the accompanying drawings, in which like reference characters refer to like parts throughout, and in which.

DETAILED DESCRIPTION

Figure 1:
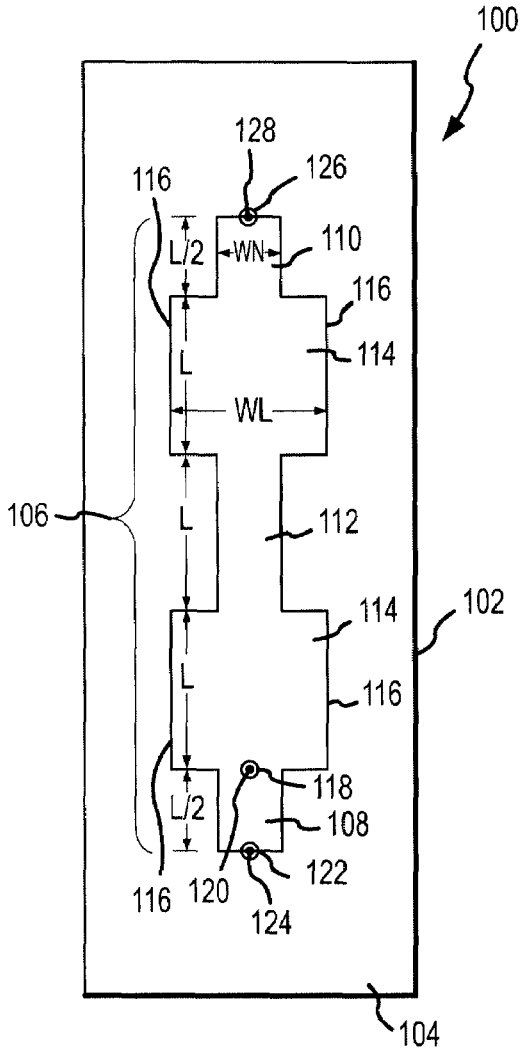
FIG. 1 is a top side plan view of a omni-directional linear array antenna in accordance with the present invention.
Figure 2:
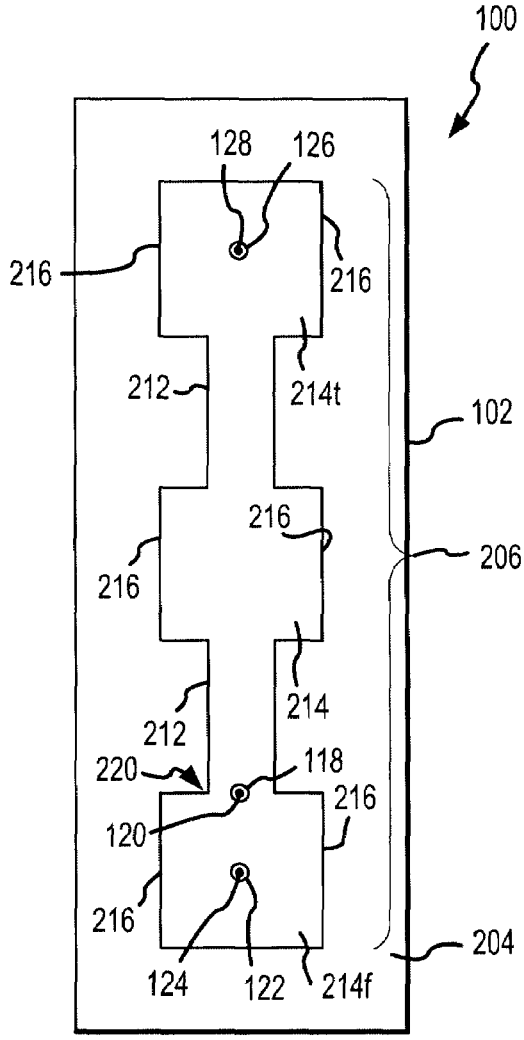
FIG. 2 is a bottom side plan view of the omni-directional linear array antenna shown in FIG. 1.

FIGS. 1 and 2 and the following paragraphs describe some embodiments of the present invention. Like reference characters are used wherever possible to identify like components or blocks to simplify the description of the various subcomponents described herein. More particularly, the present invention is described in relation to a co-linear coaxial antenna, however, one of ordinary skill in the art will understand other antenna arrays are possible without departing from the spirit and scope of the present invention.

Referring to FIGS. 1 and 2, an omni-directional linear array antenna 100 exemplary of the present invention is shown. FIG. 1 shows a top side plan view of antenna 100. FIG. 2 shows a bottom side plan view of antenna 100.

Referring first to FIG. 1, a substrate 102 is shown. While shown as having a generally rectangular shape, substrate 102 does not need to be rectangular, but could be other shapes as desired, such as a random shape, a square shape, a circular shape, and elliptical shape, or the like. Substrate 102, which is typically comprised of a printed circuit board material, provides, among other functions, separation between conductors (as described below). Instead of a solid substrate, however, substrate 102 could be comprised mostly of an air (or other gas) or vacuum gap with one or more dielectric posts or columns to provide some support to maintain a separation between conductors, as will be explained further below. Also, as explained below, substrate 102 is largely optional as shorts or other conductive connections between the conductors could be used as support elements instead of a substrate. In any event, substrate 102 has a first or top side 104. Residing on first side 104 is a conducting strip 106. As shown, conducting strip 106 has at least one feed element 108, at least one terminating element 110, and at least one narrow element 112. Narrow element 112 has a length L, which is generally about one-half wavelength at the antenna operating frequency when the substrate properties, such as the dielectric properties, are taken into account. The narrow elements generally have a width WN. Feed element 108 and terminating element 110 have an effective length of about one-quarter wavelength at the antenna operating frequency when the substrate properties are taken into account.

Interspersed between feed element 108, each first side narrow element 112, and terminating element 110 exist first side wide elements 114 having first side outside edges 116. Wide elements 114 also have a length L. Wide elements 114 have a width of WL. The width of the wide elements changes in relation to the width of the narrow elements to produce a desired driving point impedance, usually 50 ohms so that no matching network is required. For example, width WL may be 5WN. More generally, the width of the wide elements is larger than the width of the narrow elements in order for the antenna to operate. The widths (both the wide element width and the narrow element width) are changed to produce a desired aperture distribution to control side lobe level. Generally, the width of wide elements 114 should be about wide enough so that they can act as the "ground plane" portion of microstrip transmission line corresponding to the approximately narrow element, which is typically 50 ohm, but not necessarily, on the opposite side. Viewed another way, the wide section should be wide enough to present a significant impedance change.

While conducting strip 106 is shown with one narrow element 112 and two wide elements 114, more or less narrow elements 112 and wide elements 114 are possible. Notice that the widths of the wide elements and narrow elements are shown consistent in the figures for convenience, but the widths do not need to be consistent for all the wide and/or narrow elements over the length of the antenna 100. For example, one of the wide elements 114 may have a width of WL and the other wide element 114 may have widths of WL+WN, 5WN, ¾ WL, or the like, for example.

Where the widths of the narrow and wide elements control, in part, the driving point impedance, the parameter L controls, in part, the design frequency of operation and the number of sections determines the gain of the antenna. In addition, if the width of the wide elements varies among the different sections, the antenna pattern shape can be varied in some desirable ways, such as to minimize side lobes or the like.

Feed element 108 has a feed hole 118 through which a feed wire 120 passes. Feed wire 120 is attached to conductor strip 106 to supply power to conducting strip 106. Feed element 108 also has a shorting via 122 with a short 124. Shorting via 122 and short 124 could be a single conductive element. Termination element 110 has a shorting via 126 and a short 128.

Referring now to FIG. 2, substrate 102 is shown. Substrate 102 has a second side 204 with a conducting strip 206. The distance d (FIG. 3) between first side 104 and second side 204 should be electrically thin. The thickness of the substrate will have a second order effect on the antenna parameters, but the thickness is electrically thin compared to a free space wavelength. Moreover, electrically thin is a thickness that corresponds to the case where the narrow sections of width are transmission line segments, such as the 50 ohm transmission line impedance of the present invention. Second side 204 has second side wide elements 214 and second side narrow elements 212. Second side wide elements 214 have second side outside edges 216. Second side wide elements 214 are aligned substantially below first side narrow elements 112. Similarly, second side narrow elements 212 are aligned substantially below first side wide elements 114. The term below is used in a relative sense and below could actually be left of, right of, or above depending on the configuration of antenna 100.

Shorting via 122 resides in one second side wide element 214 and shorting via 126 resides in another second side wide element 214. Wide elements containing shorting vias 122 and 126 are aligned substantially below feed element 108 and terminating element 110, respectively. Short 124 and short 128 provide an electrical short between feed element 108 and corresponding second side wide element **214*f*, and an electrical short between terminating element 110 and corresponding second side wide element 214*t*. Antenna 100 also has a power feed hole 118 on second side 204. Power feed hole 118 allows the feed wire 120 to pass and supply power to conductive strip 106. Conductive strip 206 would be correspondingly connected to a ground or shield. Generally, feed wire 120 and power feed hole 118 will be located substantially aligned below a transition 220 between feed element 108 and first side wide element 114**.

Figure 4:
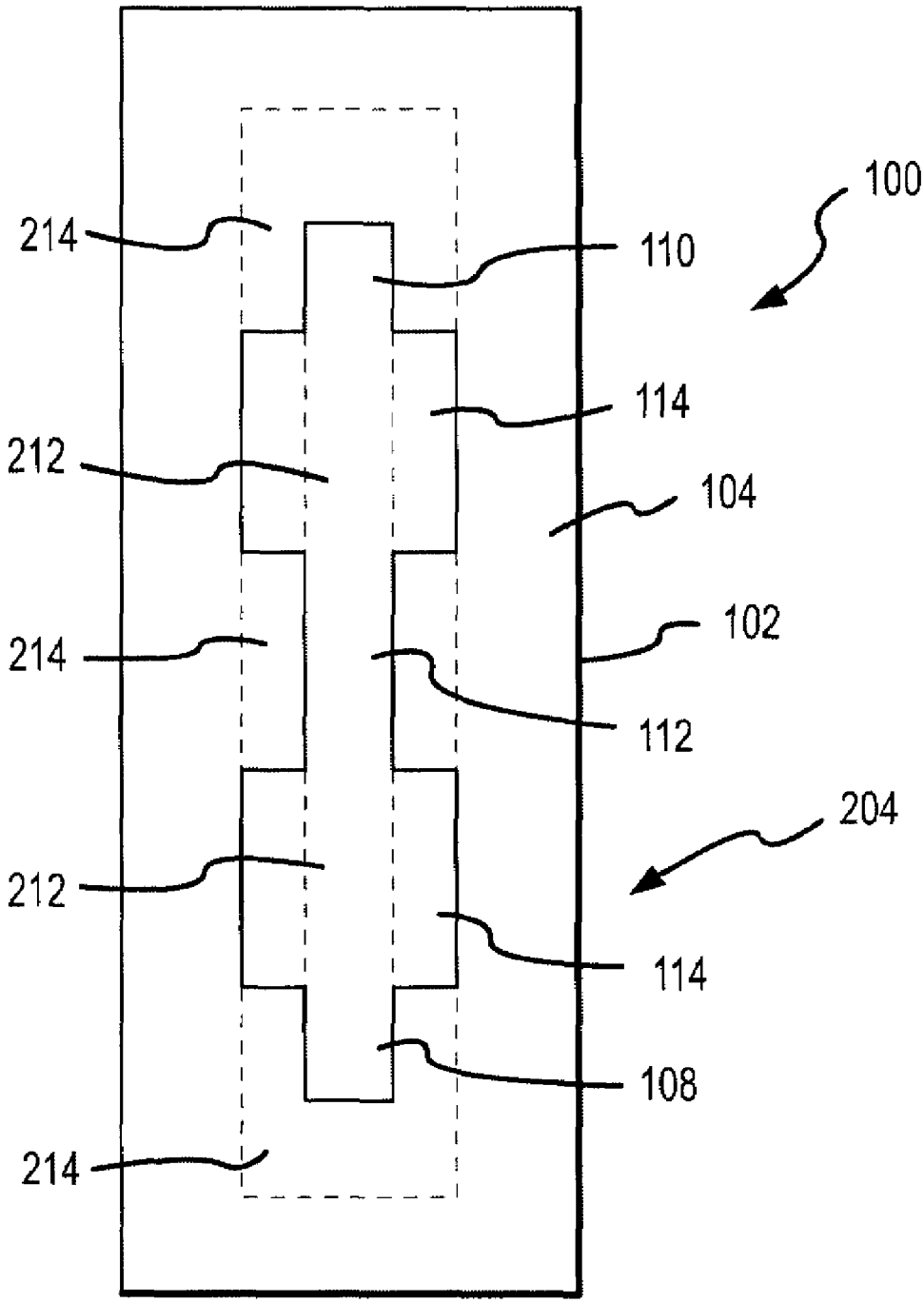
FIG. 4 shows the top side plan view of FIG. 1 with the bottom side plan view of FIG. 2 shown in phantom.

Referring now to FIG. 4, it can be seen that second side wide elements 214 are substantially aligned with feed element 108, first side narrow elements 112, and terminating element 110. Similarly, first side wide elements 114 are substantially aligned with second side narrow elements 212. This arrangement allows via 122 and short 124 to short feed element 108 to aligned second side wide element 214 and allows via 126 and short 128 to short terminating element 110 to aligned second side wide element 214. Power feed 120 is connected to a conventional antenna power supply using, for example, a conventional coaxial cable connection, connectors, or transmission lines, but any conventional power feed could be used. Further, while shown with one first side narrow element 112 and two first side wide elements 114, and three second side wide elements 214 and two second side narrow elements 112, it is possible to increase or decrease the gain of antenna 100 by adding or removing narrow elements and wide elements. Further, it would be possible to have tape pre-made with conductive trace patterns consistent with the descriptions herein. Sections of this tape could be measured off and soldered, welded, adhered, or the like to a substrate in predetermined amounts to provide particular gains, where one section of tape would be applied to one side of the substrate, and another section of tape would be applied to the opposite side of the substrate, with the opposite sections aligned as shown in FIG. 4. The necessary connections would then be made using conventional means. Alternatively, tape could be prepared with the alternating conductive sections already on both sides of the tape, which would then be cut to the desired length for the required gain and applied to a substrate for mechanical support and to facilitate making the necessary connections. It is evident from the foregoing discussion that tapes of this nature could be prepared for various desired frequencies, such as 2.4 GHz for Wireless Lan (WiFi) applications, 860 MHz for cellular communication applications, and the like.

As mentioned above, in yet another embodiment, the conductive sections could be fashioned from cut or stamped metal. In this embodiment, it would be possible to separate the two conductive strips mechanically, such as by dielectric posts or by the shorts 124 and 126, so that the space between the alternating sides was comprised mainly of air, instead of a rigid, dielectric substrate as described above. This embodiment might be particularly useful for high power applications, such as cellular communication base stations or high power radio (e.g., FM or the like) broadcast towers.

As one of ordinary skill in the art would now recognize, the narrow elements 112 and 212 simulate transmission lines. Edges 116 and 216 of the wide elements 114 and 214 act as radiating elements.

Figure 7:
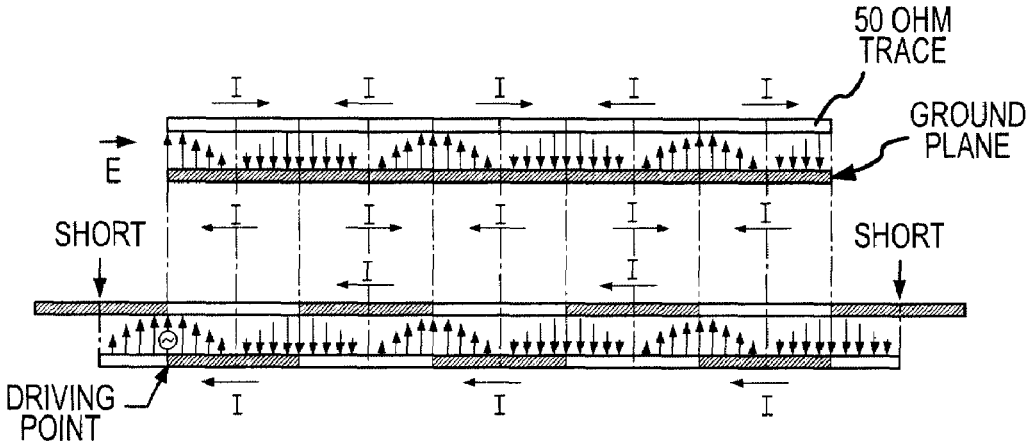
FIG. 7 is an diagrammatic view of the antenna shown in FIGS. 1-3 including electromagnetic field representations.

Although various lengths are possible, it is believed antenna 100 operates optimally when feed element 108 and termination element 110 are designed with a length of ¼ wavelength and first side narrow elements 112, first side wide elements 114, second side narrow elements 212, and second side wide elements 214 are designed with a length of ½ wavelength. An antenna using these section lengths, and when narrow elements simulate a 50 ohm microstrip transmission line, the currents (source of radiation) and the electric field may be as shown in FIG. 7. The currents on a microstrip transmission line cancel and therefore do not radiate. If the microstrip line were cut and flipped at each half-wavelength segment, the current on the "ground planes" all line up as required for an omni-directional antenna. The currents at the edge of each of the wide sections radiate to create the antenna. A short at either end is one-quarter wavelength long causing a reflected wave to be in phase at the first wide to narrow discontinuity causing the resonant structure to have currents on each wide section to remain in line as required to create an omni-directional antenna. FIG. 7 is an expansion of FIG. 3 with thickness d having sides 104 and 204 with the electromagnetics of the antenna illustrated. While the shown antenna 100 does not require a matching circuit. As one of skill in the art will recognize on reading the disclosure, however, alternative designs may require the installation of a matching network. Adjusting the widths of the individual wide elements alters the antenna pattern. Also, varying the lengths of the individual elements will alter the patterns.

Figure 3:
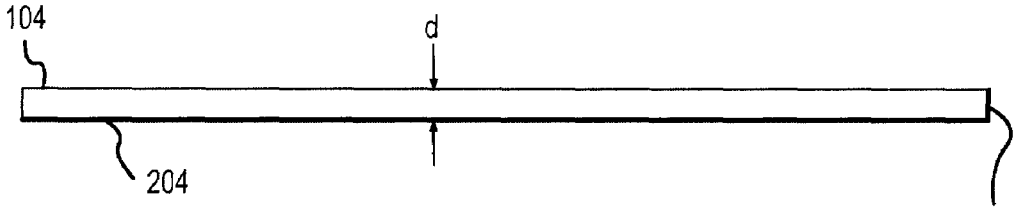
FIG. 3 is a side elevation view of the omni-directional linear array antenna shown in FIGS. 1 and 2.

Some advantages of this new antenna include that it is easier to manufacture than other designs, it is more scalable across frequency than other designs, it is more compact than other designs, and it is a relatively low cost compared to conventional, comparable omni-directional antennas. Moreover, when using a uniform series of transmission lines and alternating radiating sections, the antenna may be adapted to selectively tune sections of the antenna to different frequencies. This would be useful in broadband applications, for example, where tuning the antenna for a first frequency and then a second frequency slightly off the first frequency would allow broadband application. Even without the off-set tuning, the pattern, as shown in FIGS. 1-3, for example, allow possible wider frequency use than other conventional, comparable antenna making it possible to operate antenna 100, for example, as a tri-band antenna in, for example, 802.11a and Hyperlan regions. The present invention antenna accepts an unbalanced feed (such as a coaxial cable) and therefore does not require a balun like other conventional designs.

Figure 5:
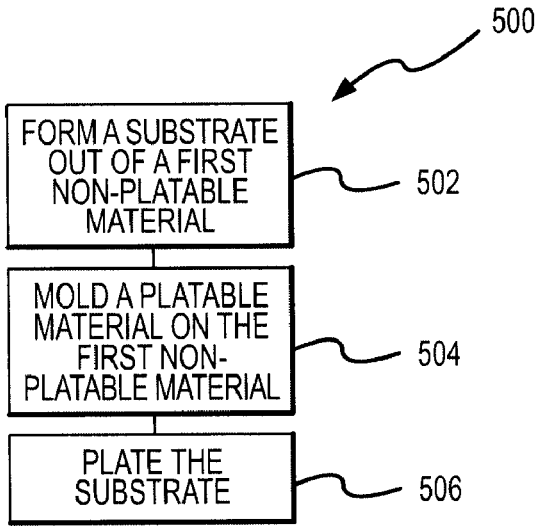
FIG. 5 is a flowchart illustrative of a method of making the present invention consistent with an embodiment thereof.

Referring to FIG. 5, a method 500 of making antenna 100 is described. First, using an injection mold to form substrate 102 out of a non-platable plastic, step 502. A second shot of platable plastic would be molded onto substrate 102, step 504. Substrate 102 would then be plated with a conductive material, such as copper, step 506. Because the plating will only adhere to the platable plastic, antenna 100 can be formed. Alternative methods of making antenna 100 include etching, metal foil and stamping, embossing, and the like.

Figure 6:
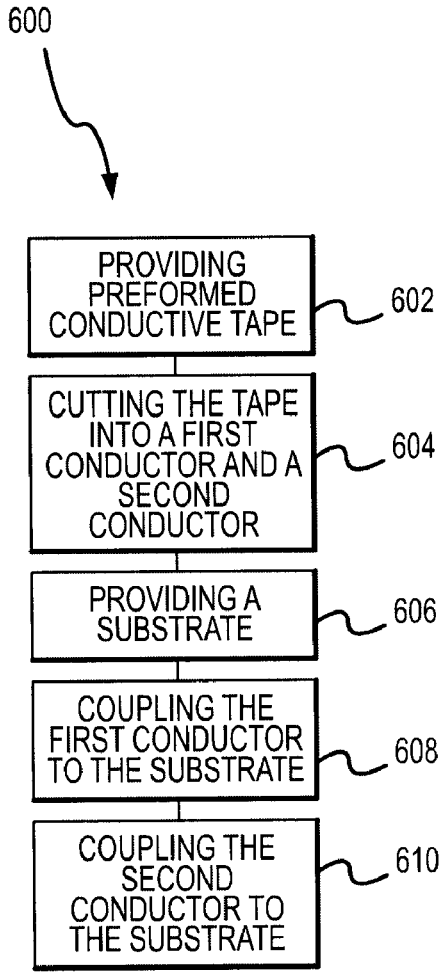
FIG. 6 is a flowchart illustrative of another method of making the present invention consistent with another embodiment thereof.

Referring to FIG. 6, another method 600 of making antenna 100 is described. First, pre-formed conductor tape comprising alternating narrow and wide sections is provided, step 602. The tape is pre-formed conductor tape is cut into a first conductor and a second conductor, step 604. A substrate is then provided, step 606. The first conductor is coupled to a first side of the substrate, step 608. The second conductor is coupled to the second side of the substrate, step 610. Finally, feed and short vias are provided as necessary, step 612.

Figure 8:
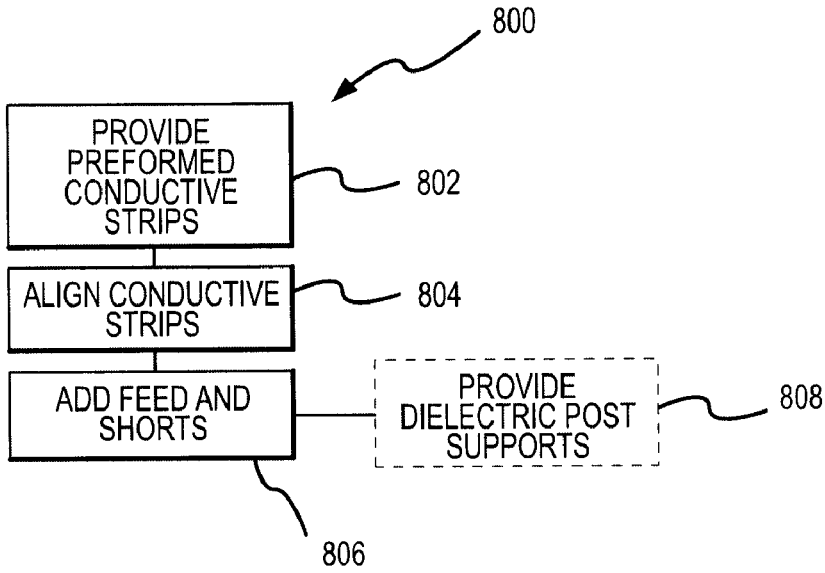
FIG. 8 is a flowchart 800 of another method of manufacturing an antenna consistent with the present invention.

Referring to FIG. 8, still another method 800 of making antenna 100 is described. First, pre-formed conductive strips are made, step 802. The preformed conductive strips are aligned as described above, step 804. Finally, feed and shorts are added to the arrangement, step 806, which may also provide separation. Optionally, additional dielectric post (or a dielectric substrate) supports may be arranged for structural support, step 808.

Figure 9:
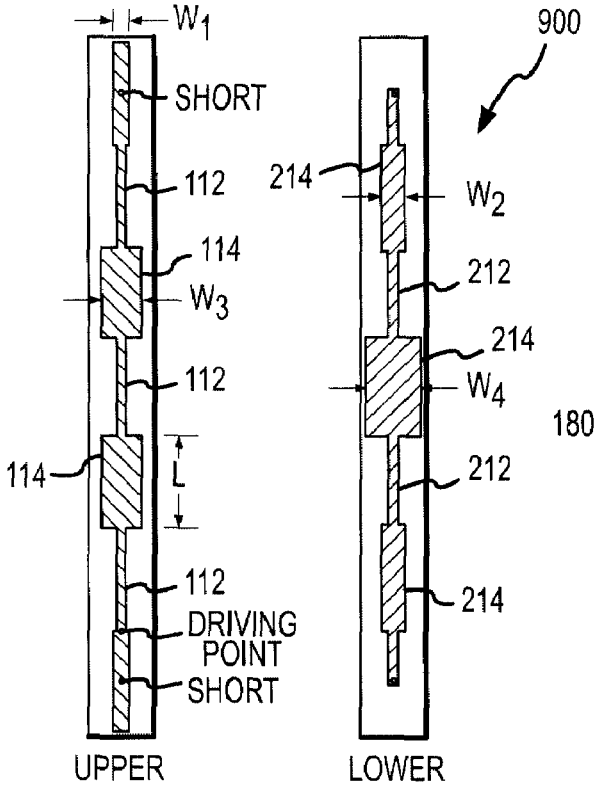
FIG. 9 is shows an antenna 900 having multiple widths consistent with an embodiment of the present invention.
Figure 10:
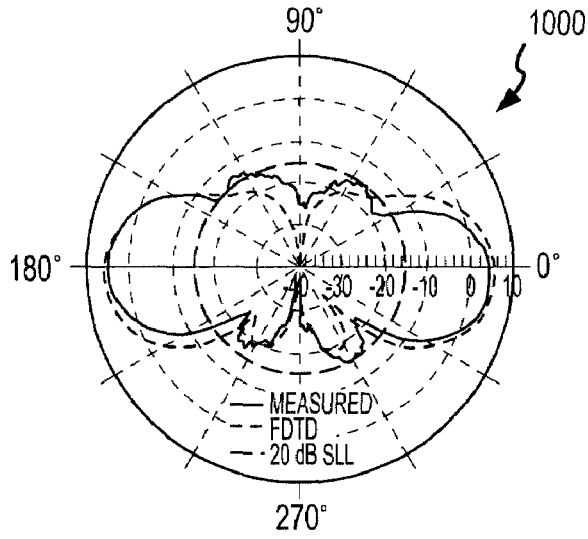
FIG. 10 is a diagrammatic representation of radiation patterns associated with the antenna of FIG. 9.

As mentioned above, antenna 100 may have various narrow elements 112, 212 and various wide elements 114, 214 with widths along the length of the conductors. FIG. 9 shows an antenna 900 with alternating widths of W1, W2, W3, and W4 as shown. FIG. 10 shows a radiation pattern 1000 associated with antenna 900.

Figure 11:
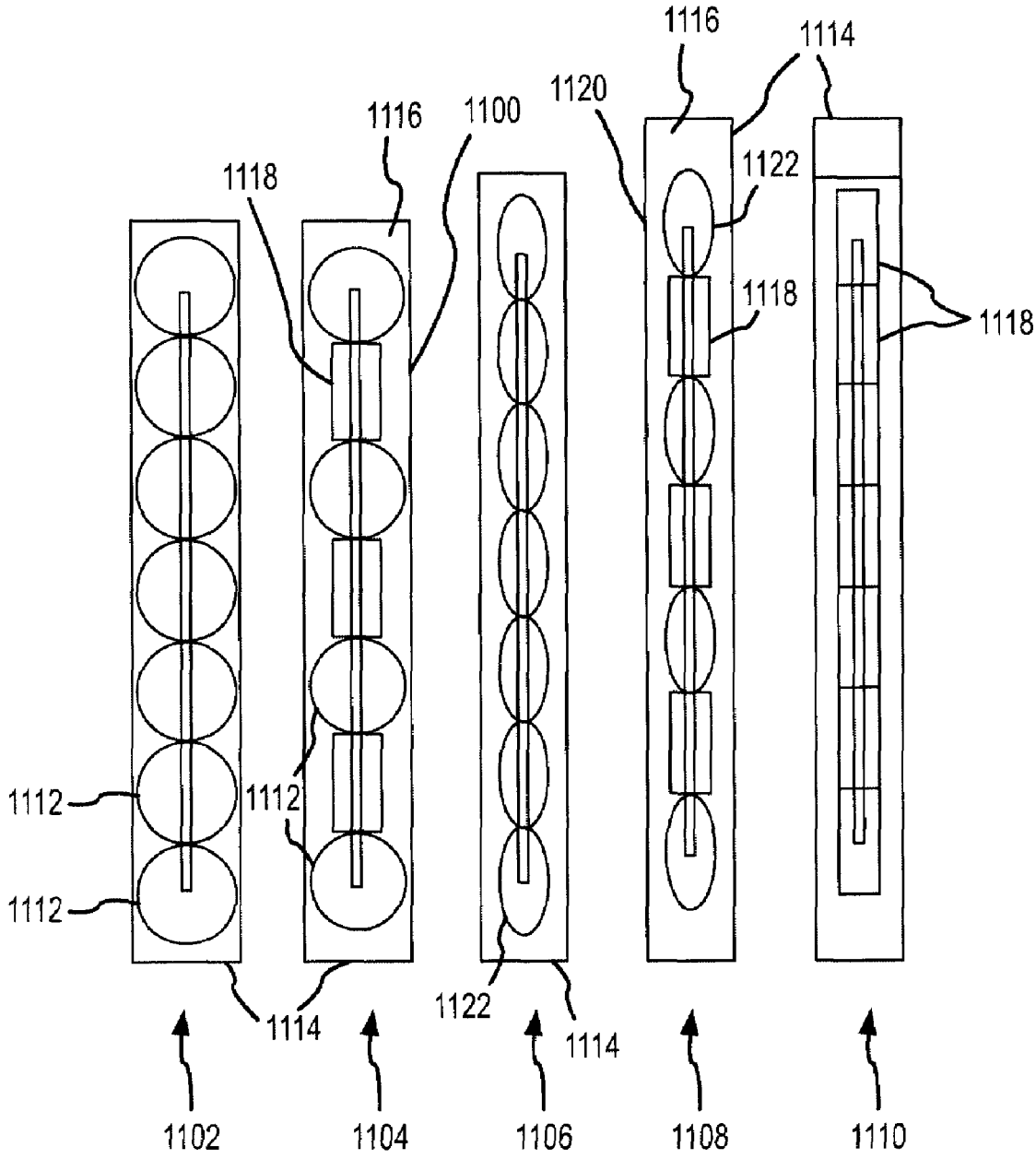
FIG. 11 is a diagrammatic representation of alternative embodiments of the an antenna constructed consistent with the present invention.

Referring now to FIG. 11, antennas 1102, 1104, 1106, 1108, and 1110 are shown. Antennas 1102, 1104, 1106, 1108, and 1110 are similar to the above antennas, and the similarities will not be further described. As can be seen, antenna 1102 has circular wide elements 1112 on both sides of substrate 1114. Antenna 1104 has circular wide elements 1112 on a first side 1116 of substrate 1114 and rectangular wide elements 1118 on a second side 1120 of substrate 1114. Antenna 1106 has elliptical elements 1122 on both sides of substrate 1114. Antenna 1108 has elliptical elements 1122 on first side 1116 and rectangular elements 1118 on second side 1120. Antenna 1110 has rectangular elements on both sides of substrate 1114. The various combinations of elements and geometric shapes alters both the antenna gain as well as the radiation pattern sidelobes. Testing of antennas 1102, 1104, 1106, 1108, and 1110 show that antenna 1108 produces the highest gain and lowest sidelobes for equivalent omni directional antennas. While it would be possible to similarly design the narrow elements, it has been found changing the narrow elements from the rectangular shape to either circular, elliptical, or combinations of circular, elliptical, and rectangular produce little to no change in antenna operating characteristics.

Figure 12:
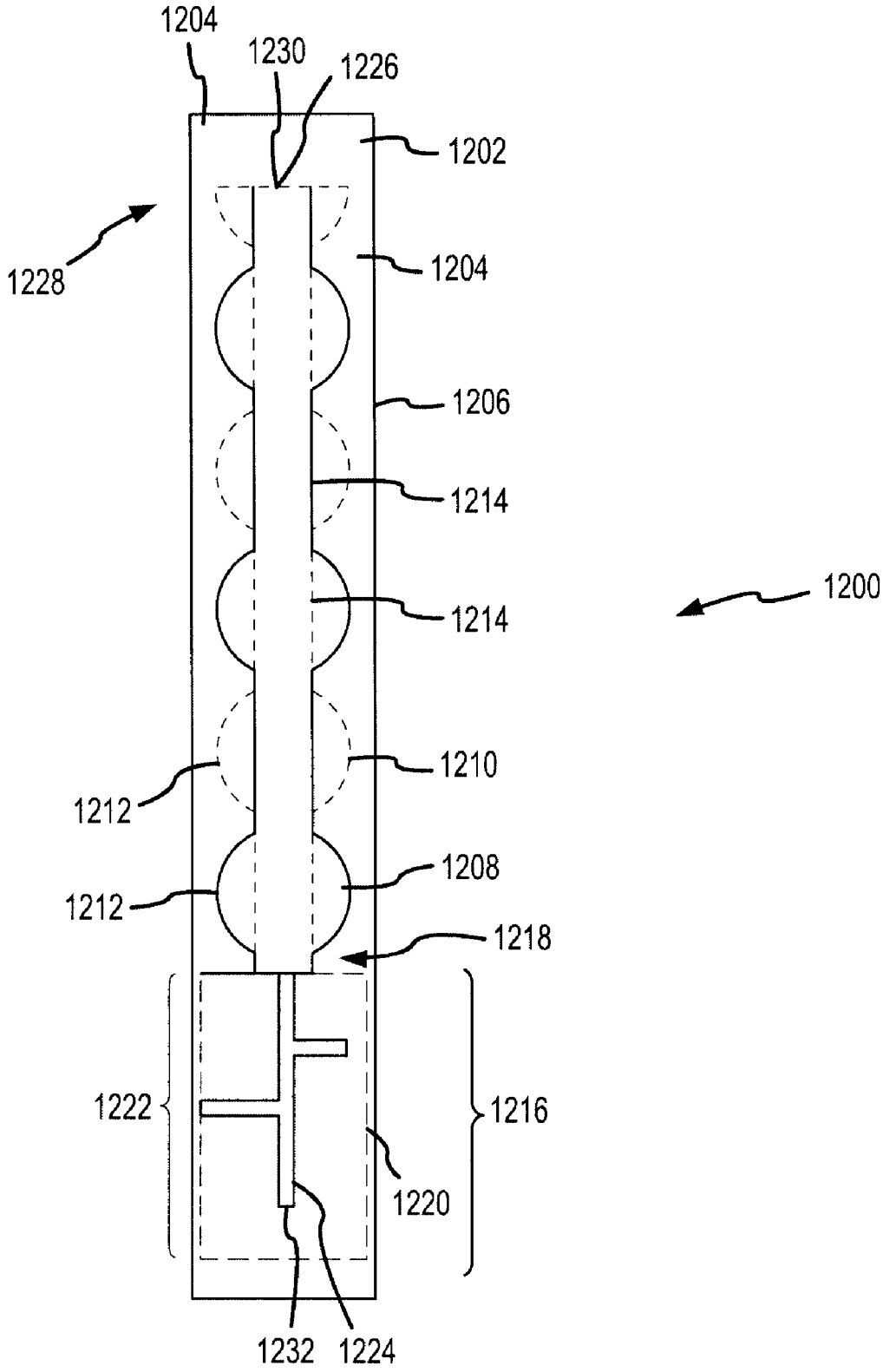
FIG. 12 is a diagrammatic representation of another embodiment of an antenna constructed consistent with the present invention.

Referring now to FIG. 12, an antenna 1200 consistent with the present invention is shown. Antenna 1200 is built on a substrate 1202 having a first side 1204 and a second side 1206. A first conductive strip 1208 resides on first side 1204 and a second conductive strip 1210 (shown in phantom) resides on second side 1206. Conductive strips 1208 and 1210 have wide elements 1212 (shown as circular elements, but could be rectangular, elliptical, or the like) and narrow elements 1214 (shown as rectangular elements, but could be circular, elliptical, or the like). A feed element 1216 is coupled to a first end 1218 of first conductive strip 1208. Feed element 1216 comprises a ground plane 1220 (shown in phantom) with microstrip impedance matching elements 1222 residing over a ground plane 1220. Ground plane 1220 is coupled to second conductive strip 1210 at the first end 1218. A termination element 1226 resides at a second end 1228 distal from first end 1218. Termination element 1226 has a short 1230, which is the only short in the construction disclosed by FIG. 12, connecting first conductive strip 1208 and second conductive strip 1210. Termination element 1226 is about ½ the length of a wide or narrow element. As can be seen, antenna 1200 differs from antenna 100 in part because of the direct feeding of antenna 1200 with a matching network and the elimination of a short between first conductive strip 1208 and 1210 at first end 1218. A conductive strip 1224 has a drive point 1232 connected to a power source (not shown).

Drive point 1232 may be connected to the power source using any conventional connection, such as, a probe fee, a coaxial cable connection, or the like.

While shown as a series of elements, more or less elements are possible than shown in any of the figures. For example, referring to FIG. 12, feed element 1216 could be aligned over a single wide element 1212 and coupled to a single wide element 1212, which would be shorted to a single narrow element 1214. Single narrow element 1214 would be coupled to the wide element 1212 aligned under the feed element 1216.

While the invention has been particularly shown and described with reference to a preferred embodiment thereof, it will be understood by those skilled in the art that various other changes in the form and details may be made without departing from the spirit and scope of the invention.

We claim:

1. An antenna, comprising:

a substrate having a first side and a second side;

a first conductor coupled to the first side of the substrate;

a second conductor coupled to the second side of the substrate;

the first conductor comprising at least one first side wide element and a first side terminating element;

the second conductor comprising at least one second side narrow element and a second side terminating element;

the at least one second side narrow element being substantially aligned with the at least one first side wide element;

the first side terminating element and the second side terminating element being substantially aligned;

a short connecting the first side terminating element and the second side terminating element;

a feed element coupled to the first side wide element, the feed element comprising at least one transmission line, at least one impedance matching element, and at least one ground plane substantially aligned with the at least one transmission line.

2. The antenna according to claim 1, wherein the, at least one first side wide elements comprise a plurality of first side wide elements;

the at least one second side narrow element comprises a plurality of second side narrow elements; and further comprising at least one first side narrow element; and at least one second side wide element, wherein the at least one second side wide element is substantially aligned beneath the at least one first side narrow element.

3. The antenna according to claim 1, wherein a power source is coupled to the feed element.

4. The antenna according to claim 2, wherein at least one of the plurality of first side wide elements has a different geometric shape than the at least one second side wide element.

5. The antenna according to claim 2, wherein at least one of the plurality of first side wide elements has a different geometric shape than another of the plurality of first side wide elements.

6. The antenna according to claim 2, wherein the plurality of first side wide elements comprise an elliptical geometric shape and the at least one second side wide element comprises a rectangular geometric shape.

7. The antenna according to claim 6, wherein the elliptical geometric shape is a circle.

8. The antenna according to claim 7, wherein the rectangular geometric shape is a square.

9. An antenna, comprising:

a first conductor having a first end and a second end;

the first conductor comprising a plurality of first circular elements connected by at least one first narrow element;

a second conductor spaced apart from the first conductor and having a first end and a second end;

the second conductor comprising a plurality of second narrow elements substantially aligned with the plurality of first circular elements and at least one second circular element substantially aligned with the at least one first narrow element;

a feed element coupled to the first end of the first conductor and the first end of the second conductor; and a termination element coupled to the second end of the first conductor and the second end of the second conductor, the termination element comprising a narrow element and a wide element substantially aligned with the narrow element and shorted together.

10. The antenna according to claim 9, further comprising a substrate between the first conductor and the second conductor.

11. The antenna according to claim 9, wherein the feed element comprises a microstrip transmission line coupled to the first conductor and a ground plane substantially aligned with the microstrip transmission line and coupled to the second conductor.

12. The antenna according to claim 9, wherein the termination element is approximately ½ a diameter of the plurality of circular elements.

13. The antenna according to claim 10, wherein the substrate comprises a printed circuit board.

14. The antenna according to claim 9, wherein the plurality of narrow elements comprise a shape and the shape is selected from a group of shapes consisting of: rectangular, square, elliptical, or circular.

15. The antenna according to claim 9, wherein a diameter of the plurality of circular elements equals a ½ wavelength.

16. The antenna according to claim 9, wherein a diameter of the plurality of circular elements equals a ¼ wavelength.

17. The antenna according to claim 9, wherein at least one diameter of the plurality of circular members is different than another diameter.

* * * * *